United States Patent [19]

Friedman et al.

[11] Patent Number: 4,631,447

[45] Date of Patent: Dec. 23, 1986

[54] IREB CONVERTER TO AC PULSES

[75] Inventors: Moshe Friedman, Washington, D.C.; Victor Serlin, Springfield, Va.

[73] Assignee: The United States of America as represented by the Secretary of the Navy, Washington, D.C.

[21] Appl. No.: 661,838

[22] Filed: Oct. 17, 1984

[51] Int. Cl.[4] ..... H01J 25/02

[52] U.S. Cl. ..... 315/5; 315/3.6; 315/4; 315/5.38; 315/5.29; 372/2

[58] Field of Search ..... 315/5, 3.6, 4, 5.38, 315/5.29; 372/2

[56] References Cited

U.S. PATENT DOCUMENTS 3,916,246 10/1975 Preist ..... 315/5
4,215,291 7/1980 Friedman ..... 315/4

OTHER PUBLICATIONS

M. Friedman, V. Serlin, A. Drobot and Larry Seftor, Propagation of Intense Relativistic Electron Beams through Drift Tubes with Perturbed Walls, Physical Review Letters, vol. 50. No. 42, 13 Jun. 1983.

M. Friedman and V. Serlin, "Conversion of the Energy of Intense Relativistic Electron Beams into Highpower Electrical Pulses", Rev. Sci. Instrum. 54(12), Dec. 1983.

M. Friedman, Automodulation of an Intense Relativistic Electron Beam, Physical Review Letters, vol. 32, No. 8, 21 Jan. 1974.

M. Friedman and M. Ury, Production and Focusing of a High Power Relativistic Annular Electron Beam, The Review of Scientific Instruments, vol. 41, No. 9, 1334–1335, Sep. 1970.

*Primary Examiner*—Palmer C. DeMeo
*Assistant Examiner*—M. Razavi
*Attorney, Agent, or Firm*—Sol Sheinbein; William T. Ellis

[57] ABSTRACT

A device for converting the kinetic energy of an intense relativistic electron beam (IREB) into trains of multi-gigawatt AC electrical pulses comprising a foilless diode for generating an IREB and injecting the IREB into one end of a drift tube. The device further includes a modulating circuit for modulating the IREB current while in the drift tube to obtain longitudinally spaced bunches of electrons, and a coaxial transmission line with the end of its center conductor disposed across the other end of the drift tube in the path of the IREB. A gap is disposed between the end of the drift tube and the end of the center conductor. The modulated IREB induces a voltage in the coaxial transmission line. This voltage appears across the gap to slow down the electrons and to convert the kinetic energy of the IREB into electrical energy that propagates along the coaxial transmission line.

9 Claims, 6 Drawing Figures

IREB CONVERTER TO AC PULSES

BACKGROUND OF THE INVENTION

The present invention relates generally to the field of high electrical power DC-to-AC converters, and more particularly to a device for converting an intense relativistic electron beam into high power AC pulses.

In general, a DC-to-AC converter has three main components:

(1) An electron gun to produce an electron beam.

(2) A device to launch the electron beam.

(3) A device to convert the energy of the launched beam into electrical pulses.

In conventional high power DC-to-AC converters, such as vacuum triode tubes, the current is limited by the presence of the triode grid (at very high electrical power the grid eventually evaporates). Additionally, the voltage of such a triode tube is limited by the size of the tube, since there must be a certain distance between the electrodes to prevent voltage breakdown. Consequently, the power of such triode tubes is limited to about 1 MW. The Klystron, another form of vacuum tube, converts DC energy to RF radiation. However, the highest output power from such a Klystron is of the order of 100 MW.

An option for obtaining an electrical pulse is to use an intense relativistic electron beam (IREB) and then to convert the kinetic energy of the electrons in that beam into electrical energy. This can be used in many electron devices of low efficiency (e.g., free electron lasers) in order to recover and recirculate the electron energy. The converting circuits used for collecting the electrons from the IREB and converting their kinetic energy into electrical energy should not interfere with the operation of the electron devices. One such low power system is disclosed in the U.S. Pat. No. 3,916,246 to Preist. The Preist patent extracts the kinetic energy from the electron beam in one embodiment by collecting the beam current at a potential substantially equal to the potential of the electron source. The foregoing design is extremely inductive and thus, will not work for kilo amp current—megavolt electron beams.

OBJECTS OF THE INVENTION

Accordingly, it is an object of the present invention to convert the kinetic energy of a quasi-DC high current relativistic electron beam into trains of multi-gigawatt AC electrical pulses.

It is a further object of the present invention to convert the kinetic energy of high power IREB's into electrical pulses with good efficiency.

It is a still further object of the present invention to prevent the formation of a virtual cathode due to the interception of IREB by the converter and to minimize counterstreaming electrons.

It is a yet further object of the present invention to reduce distortion of the output electrical pulses from the DC-to-AC converter.

It is a still further object of the present invention to provide a DC-to-AC converter with an output power of up to 3 orders magnitude higher than conventional converters, in conjunction with good efficiency.

It is a still further object of the present invention to provide a DC-to-AC converter which may be scaled up to very high energy outputs.

Other objects, advantages, and novel features of the present invention will become apparent from the detailed description of the invention, which follows the summary.

SUMMARY OF THE INVENTION

Briefly, the above and other objects may be realized in a device for converting the energy of an intense relativistic electron beam into high power AC electrical pulses, comprising a longitudinally-running drift tube with a first and second ends; a circuit for generating an intense relativistic electron beam (IREB) and injecting the IREB to propagate along a path in the drift tube from the first end thereof; and means for modulating the IREB with at least one frequency to obtain longitudinally spaced bunches of electrons in the drift tube. The device further includes a coaxial circuit including an outer conductor and a center conductor with an end of the center conductor disposed across the second end of the drift tube in the path of the IREB. A gap is disposed between the second end of the drift tube and the end of the center conductor for converting the kinetic energy of the electron bunches in the drift tube into electrical energy for propagation along the coaxial circuit.

In a preferred embodiment of the present invention, the IREB is generated by a foilless diode, and the generated IREB is confined and guided by means of a magnetic field. The modulating circuit may be comprised of two or more passive cavities partially opening onto the drift tube.

BRIEF DESCRIPTION OF THE DRAWINGS

FIG. 2(*b*) is a graph showing the diode current versus time.

FIG. 2(*c*) is a graph showing the load voltage versus time.

FIG. 2(*d*) is a graph showing the load current versus time.

FIG. 2(*e*) is a graph showing the electron beam current propagating in the drift tube versus time.

DETAILED DESCRIPTION OF THE PREFERRED EMBODIMENT

Figure 1:
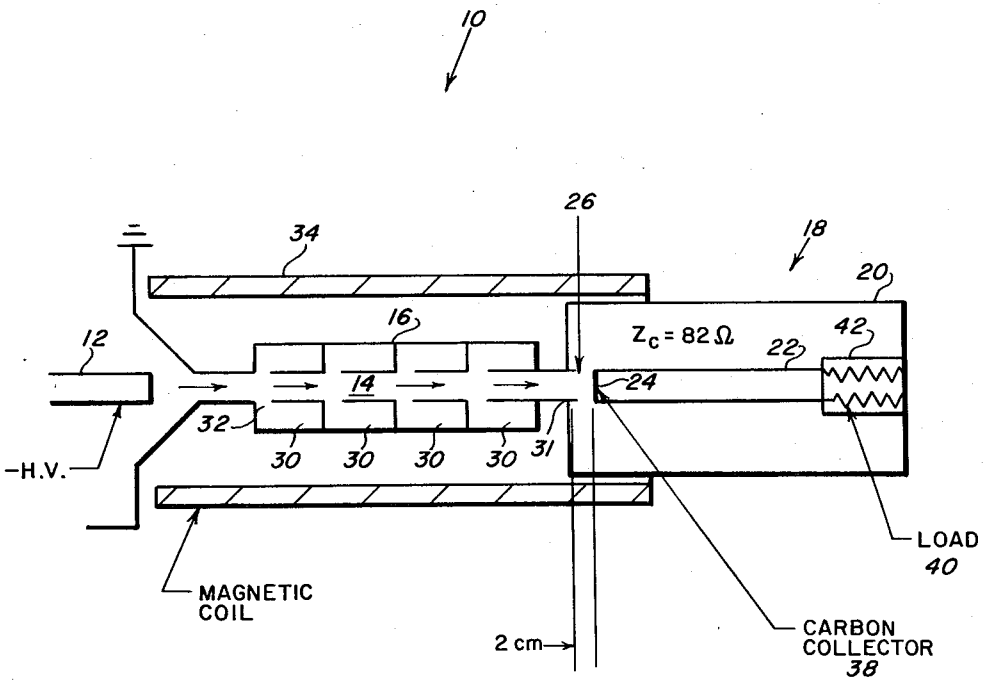
FIG. 1 is a schematic diagram of one embodiment of the present invention.
Figure 2A:
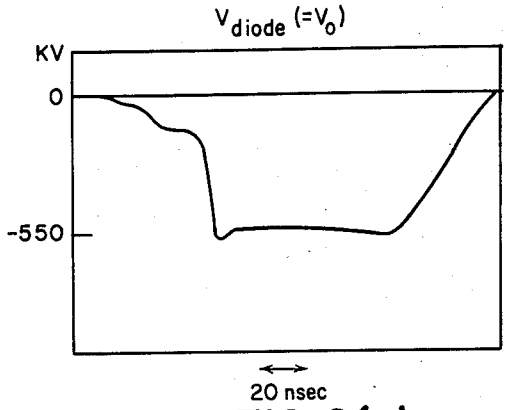
FIG. 2(*a*) is a graph showing the diode voltage versus time.
Figure 2B:
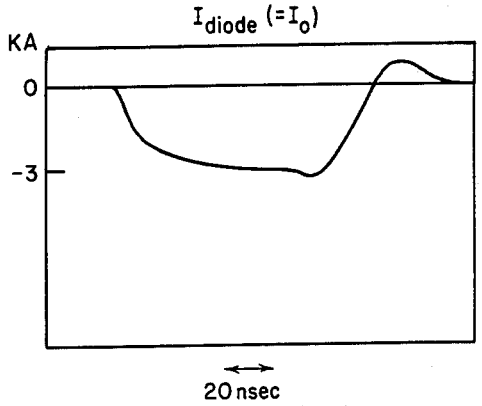
Figure 2C:
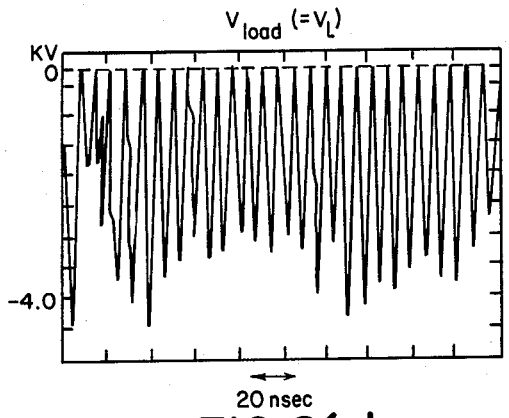
Figure 2D:
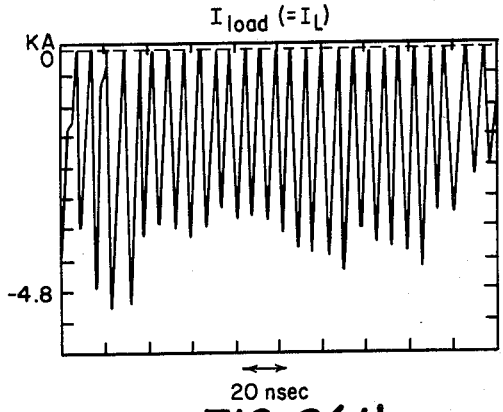
Figure 2E:
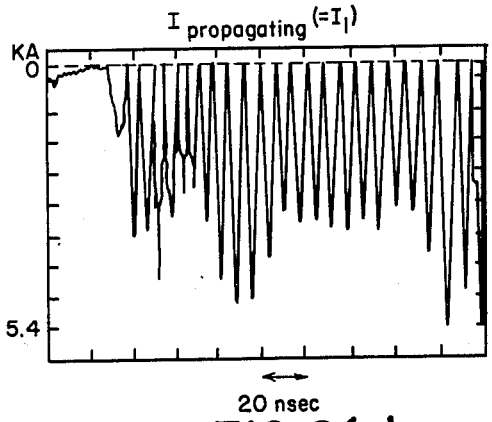

The DC-to-AC converter 10 of the present invention is shown in FIG. 1. This converter 10 comprises a circuit 12 for generating an intense relativistic electron beam (IREB), a drift tube 14 for propagating this IREB along a path, and a modulating circuit 16 for modulating the IREB propagating in the drift tube 14 with at least one frequency to obtain longitudinally spaced bunches of electrons in the drift tube 14 in accordance with this at least one frequency. The device further includes a coaxial circuit 18 including an outer conductor 20 and an inner conductor 22 with one end 24 of the inner conductor disposed across the second end of the drift tube 14 in the path of the IREB. A gap 26 is disposed between the second end of the drift tube 14 and the end 24 of the center conductor for converting the kinetic energy of the electron bunches in the drift tube 14 into electrical energy for propagation along the coaxial circuit 18.

In the embodiment shown in FIG. 1, the IREB generating circuit may be comprised of a foilless diode of the type disclosed in the article by M. Friedman and M. Ury, The Review of Scientific Instruments, Vol. 41, No. 9, pages 1334–1335, September 1970 and Vol. 43, page 1659 (1972). Foilless diodes are advantageous in that they can be used repetitively (There is no foil to be destroyed.) The IREB's generated by the foilless diodes 12 may take a variety of shape including annular and radial.

In the foilless diode 12 utilized in FIG. 1, an annular IREB of 400–800 kV voltage and of 2–7 kA current was utilized. The generated IREB is propagated through the evacuated drift tube 14. By way of example, this drift tube 14 may be 5 cm in diameter with a length of one meter. Typically, the pressure in the device will be on the order of $10^{-5}$ Torr of air or less. The drift tube may be made of stainless steel tube.

A variety of circuits may be utilized to modulate the IREB with at least one frequency to obtain longitudinally spaced bunches of electrons in the drift tube 14. In the embodiment shown in FIG. 1, a passive circuit is utilized comprising two or more cavities 18 partially opening via gaps 32 onto the drift tube 14 and disposed symmetrically therearound. In essence, these cavities 18 operate to store energy and then to add or subtract energy from the IREB propagating along the path of the drift tube 14. The mutual interaction between these cavities 18 and the IREB causes the modulation of the IREB to one or more frequencies. This modulation takes the form of longitudinally spaced bunches of electrons along the drift tube 14. The precise frequency of modulation of the IREB will depend on the geometry of the cavities (i.e., the volume and width of the individual cavities), the distance between adjacent gaps 32 which connect the cavities 30 to the drift tube 14, the size of the gaps 32 and the shape of the gaps 32. Essentially, by changing the geometry of the cavities 30 and/or the shape and size of the gaps 32, the frequency of modulation is changed.

In FIG. 1, the cavities 30 are shown as being disposed coaxially around the drift tube 14 with the cavities disposed serially along the length of the drift tube. It should be noted that this serial and coaxial configuration of the cavities 30 is set forth by way of example only. The only requirement for the cavity location is that the cavities be symmetric about the beam so that the beam is not disturbed. Accordingly, these cavities need not be annular in shape, but may take a radial shape. Additionally, these cavities do not have to be directly adjacent to the drift tube provided that the cavities 30 are connected to the drift tube 14 by means of some form of opening 32. Additionally, although the cavities are shown as being adjacent to each other, these cavities may also be separated from each other. Moreover, although four cavities are shown in FIG. 1, any number of cavities 30 may be conveniently utilized provided that there are at least two such cavities 30. For further information on this type of passive IREB modulation, see the article by M. Friedman, Physical Review Letters, Vol. 32, No. 3, page 92 (Jan. 21, 1974); and the article by M. Friedman, V. Serlin, A. Drobot, and L. Seftor, Physical Review Letters, Vol 50, No. 24, page 1922 (June 13, 1983).

In the cavity 30 configuration shown in FIG. 1, the cavities are 16 cm in length with a 15 cm outer diameter. The gap opening 32 between the cavity 30 and the drift tube 14 may be 2 cm. This four cavity modulating circuit 16 with the above described dimensions yields a modulating frequency of 280 MHz.

A magnetic field generating means 34 is utilized to generate a magnetic field to confine the IREB within the drift tube 14 and to guide it into the gap 26. This confining magnetic field may be generated by a DC or pulse magnetic coil or by means of a DC superconducting coil. In FIG. 1, 34 designates a solenoid coil comprising either continuous or pancake solenoid coils. For example, the coils 34 of FIG. 1 are utilized to generate a 16 kG quasi-DC magnetic field for confining the beam.

The coaxial circuit 18 comprises a coaxial transmission line with the outer conductor 20 and the inner conductor 22. This coaxial transmission line 18 is disposed so that the end 24 of its inner conductor 22 is disposed across the second end of the drift tube 14 but separated therefrom by the gap 26. In the example embodiment of FIG. 1, the transmission line 18 may have a characteristic impedance $Z_c=82$ ohms, with an outer conductor diameter of 8 inches, a center conductor diameter of 2 inches, and a length of 1.5 meters. The outer conductor 20 of this transmission line 18 connects to the second end of the drift tube 14 such that the drift tube and the outer conductor 20 are at the same electrical potential.

The IREB, after propagating through the drift tube 14 and across the gap 26, impinges on the end 24 of the inner conductor 22 to thereby produce a current on the inner conductor and a voltage $V_L$ between the inner conductor 22 and the outer conductor 20. This voltage $V_L$ is equal to the current of the electron beam $I_L$ times the characteristic impedance Z, i.e., $V_L=I_LZ$. This voltage appears also between the inner conductor 22 and the second end 31 of the drift tube and acts to slow down the electrons in the IREB. The slowing or deceleration of the IREB acts to convert the kinetic energy of the IREB into electromagnetic energy. This electromagnetic energy propagates between the conductors 20 and 22 in the coaxial transmission line 18. It is desired to convert most of the kinetic energy of the electron beam into electrical energy, as opposed to heat energy. Hence, $V_L$ should be equal as much as possible to the electron beam energy. The gap 26 thus performs the essential function of forming an electrical field between the inner conductor 22 and the second end 31 of the drift tube 14. This electrical field decelerates the electrons and provides an electrical force opposing the propagation of the electron beam to the right toward the inner conductor 22.

Typically, the width of the gap 26 is determined empirically. If the gap 26 is made very small, a very high E field across the gap 26 is formed. This electric field can cause significant secondary electron emission. Secondary electron emission is simply the emission of electrons from the end of the conductor 22 backwards, i.e., in the direction opposite to the beam propagation. If the gap 26 is made too large, the space charge voltage generated by the charge on the electrons as they pass through the gap 26 becomes very large. If this space charge is large enough, it will cause a virtual cathode formation. This virtual cathode formation will cause a decrease in the current propagating in the IREB. Accordingly, the gap 26 must be set in order to avoid significant secondary emission while keeping the space charge voltage as low as possible.

In the experiments, when the gap 26 was less than 1 cm, the current $I_L$, measured at the gap was reduced from the original value $I_1$, indicating the secondary emission of electrons across the gap 26 counterstreaming the IREB. This secondary emission, in turn, reduced $V_L$, since $V_L=I_L Z$. When the gap 26 was greater than 3 cm, a virtual cathode reappeared with an erratic behavior of the IREB current $I_1$. For an optimum gap size, the secondary emission was quenched and no virtual cathode appeared. This optimum gap size, 2 cm in the present case, depends on the electron beam current and voltage.

A carbon plate 38 may be disposed across the end 24 of the inner conductor 22 in order to minimize secondary electron emission. In the alternative, the center conductor 22 could be made hollow and the IREB could be directed into the hollow center conductor to obviate the secondary emission problem.

Typically, the coaxial transmission line 18 will be terminated by some form of load 40. In the actual device built, a load 40 comprising nine parallel rows of 14 Allen Bradley resistors, with each resistor being 62 ohms, was utilized. These load resistors 40 were housed inside a glass tube 42 filled with mineral oil. The purpose of the mineral oil was to prevent high voltage-flashover on the surface of the resistors.

The graphs of FIG. 2 show the voltages and currents developed on the load under the condition of a quiescent flow of the IREB i.e., no virtual cathode formation. At this condition of quiescent IREB flow, the foilless diode voltage $V_o$ is shown in FIG. 2(*a*), and the foilless diode 12 current $I_o$ is shown in FIG. 2(*b*). Likewise, the load voltage $V_L$ is shown in FIG. 2(*c*), while the load current $I_L$ is shown in FIG. 2(*d*). The IREB current $I_1$ propagating before entering the gap 26 is shown in FIG. 2(*e*). The current and voltage modulation on the load can clearly be seen in FIGS. 2(*c*) and (*d*). The efficiency of the total converter system is $$n = \frac{1}{2}\ \frac{I_2V_2}{I_0V_0} \approx 50\%$$

where $V_o$ and $I_o$ are the foilless diode 12 voltage and current respectively, and $V_L$ and $I_L$ are the load voltage and current, respectively.

The conversion efficiency for the present device cannot be one hundred percent because the electrons in the IREB have to have a minimum of kinetic energy in order to overcome the self potential hill developed due to the space charge at the gap 26. In the present design, it is estimated that this potential hill has a height of approximately 0.2 $V_o$. In such a case, monoenergetic electrons can only lose 80% or less of their kinetic energy. But since the IREB has a radial shear in the electron kinetic energy, and since the voltage of the collecting end 24 for the center conductor 22 should be chosen to drain only approximately 80% of the slowest electrons in the beam, the total efficiency is lower than 80%.

The axial velocity spread of the beam electrons does have an effect on the converter efficiency, but it cannot be estimated quantitatively.

The efficiency was also affected by the current in the IREB being shunted because of stray capacitance C associated with the gap 26. It was found that at the frequency F=280 Mc/s, $2\pi fZC$ is approximately 0.20. This shunt impedance can introduce approximately a 5% loss of current in the beam and this, in turn, reduces the voltage by approximately 5%, for a total loss in energy of approximately 10%.

Additionally, the efficiency may also be affected by the resistive load which may have stray electrical elements which become important at high frequencies. For further detailed information on the experiments conducted with the design shown in FIG. 1, see the article by M. Friedman and V. Serlin in the Review of Scientific Instruments, Vol. 4, No. 12, page 1764 (December 1983).

The present invention discloses a DC-to-AC converter for an IREB in which the energy of a quasi-DC electron beam is converted into a train of multi-gigawatt electrical pulses with an efficiency of 50% or greater, and with a frequency of up to 3 GHz and possibly higher. This device has a power output of 2 to 3 orders of magnitude higher than conventional DC-to-AC converters. It should also be noted that the present design can easily be scaled up to higher energy outputs. This scaling feature is significant.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A device for converting the energy of an intense relativistic electron beam having a current between 1 kiloamp and 1 megaamp into high power AC electrical pulses comprising:

a longitudinally-running drift tube with a first and second ends;

means for generating an intense relativistic electron beam (IREB) and injecting said IREB to propagate along a path in said drift tube from said first end thereof;

means for modulating said IREB with at least one frequency to obtain longitudinally spaced bunches of electrons in said drift tube in accordance therewith;

coaxial means including an outer conductor and a center conductor with an end of said center conductor disposed across the second end of said drift tube in the path of said IREB; and a gap disposed between the second end of said drift tube and the end of said center conductor;

wherein said coaxial means in combination with said gap acts to convert the kinetic energy of the electron bunches in said drift tube into electrical energy for propagation along said coaxial means.

2. A device as defined in claim 1, wherein said modulating means includes means for generating a field to confine said IREB and to guide said IREB into said gap.

3. A device as defined in claim 2, wherein said field generating means includes means for generating a confining magnetic field.

4. A device as defined in claim 1, wherein said IREB generating means comprises a foilless diode.

5. A device as defined in claim 1, wherein said modulating means comprises at least two cavities partially opening into and formed coaxially around said drift tube.

6. A device as defined in claim 5, wherein said modulating means comprises four coaxial cavities disposed serially along a portion of the length of said drift tube.

7. A device as defined in claim 5, wherein said coaxial means includes a load termination.

8. A device as defined in claim 5, wherein said end of said center conductor of said coaxial means is covered by a carbon plate.

9. A method for converting the energy of an intense relativistic electron beam having a current between 1 kiloamp and 1 megaamp into high power AC electrical pulses, comprising:

generating an intense relativistic electron beam (IREB) and injecting said IREB into the first end of a drift tube to propagate along a path in said drift tube;

modulating said IREB with at least one frequency to obtain longitudinally spaced bunches of electrons in said drift tube in accordance therewith;

guiding said IREB across a gap at a second end of the drift tube onto a center conductor of a coaxial transmission line in order to convert the kinetic energy of the electron bunches in said drift tube into electrical energy for propagation along said coaxial transmission line.

* * * * *